US006014884A

United States Patent [19]

Bartholomew

[11] Patent Number: 6,014,884

[45] Date of Patent: Jan. 18, 2000

[54] METHOD OF BENDING TUBING

[75] Inventor: Donald D. Bartholomew, Mt. Clemens, Mich.

[73] Assignee: Proprietary Technology, Inc., Bloomfield Hills, Mich.

[21] Appl. No.: 08/988,618

[22] Filed: Dec. 11, 1997

[51] Int. Cl.[7] ..... B21D 7/00

[52] U.S. Cl. ..... 72/369

[58] Field of Search ..... 72/369

[56] References Cited

U.S. PATENT DOCUMENTS 3,620,066 11/1971 Henkel et al. ..... 72/362

4,704,886 11/1987 Evert et al. ..... 72/369

5,483,809 1/1996 Nishiie et al. ..... 72/369

5,682,781 11/1997 Schwarze ..... 72/369

*Primary Examiner*—Lowell A. Larson

*Attorney, Agent, or Firm*—Harness, Dickey & Pierce, PLC

[57] ABSTRACT

A method for bending metal tubing which minimizes the collapse of a tube wall through lowering material stress achieved by reducing the rate of bending. The method includes the steps of selecting a bend radius less than a standard bend radius, determining a rate of bending of a length of tubing so as to minimize material stress, and bending the tubing at the selected determined rate.

12 Claims, 2 Drawing Sheets

METHOD OF BENDING TUBING

BACKGROUND OF THE INVENTION

1. Field of the Invention

This invention relates to manufacturing processes for bending metal, and more particularly to a method for bending steel tubing.

2. Description of Related Art

Metal tubing has a variety of uses and a variety of applications. A typical use of metal tubing is as a conduit for transporting fluid. Automobile manufacturers typically incorporate metal tubing in the design of automobiles for the purpose of transporting fluids. An example of the use of metal tubing in a vehicle is a fuel line. In order for a fuel line to be properly routed in a vehicle a number of bends may be necessary.

When metal tubing is being used as a conduit to transport fluid, such as fuel in a fuel line, avoiding restrictions to the flow is necessary to optimize system efficiency. When metal tubing is bent, the outside diameter of the bend radius typically experiences a collapse. The collapse creates a reduction in flow area; flow area is the cross-sectional area perpendicular to the fluid flow field. When flow area is reduced the result is a restriction to fluid flow.

In order to achieve a minimum collapse of the tubing wall as a result of bending, an appropriate bend radius must be selected. For example, a ⅜ inch O.D. steel tubing must have a bend radius of three inches to achieve a minimum collapse of the wall of the tubing whereby the reduction in the flow area is in the range of 11–15%. However, this bend radius may pose problems in the event that the radius is too large to achieve adequate routing. In this particular instance it may be necessary to substitute a connector, such as a "banjo connector," for the bent section of tubing. The disadvantage of using a connector such as a banjo connector is the high cost in comparison to bending the steel tubing. Therefore, there is a need for an improved method of bending tubing where the collapse of the tubing wall is minimized while also substantially reducing the required bend radius to achieve the desired minimum wall collapse.

SUMMARY OF THE INVENTION

Accordingly, it is a primary object of the present invention to provide a method for bending metal tubing wherein a reduced bend radius may be achieved while collapse of a tube wall is minimized by minimizing material stress achieved by reducing the rate of bending.

Another object of the present invention is to provide a method for bending tubing wherein the reduction in wall thickness is minimized by minimizing material stress achieved by reducing the rate of bending.

DESCRIPTION OF THE PREFERRED EMBODIMENT

Figure 1:
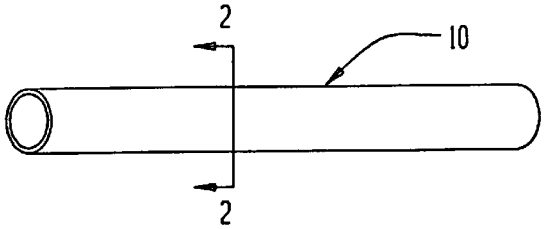
FIG. 1 is an illustration of a length of small diameter metal tubing.
Figure 2:
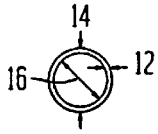
FIG. 2 is a cross-sectional view taken along the line 2—2 of FIG. 1.
Figure 3:
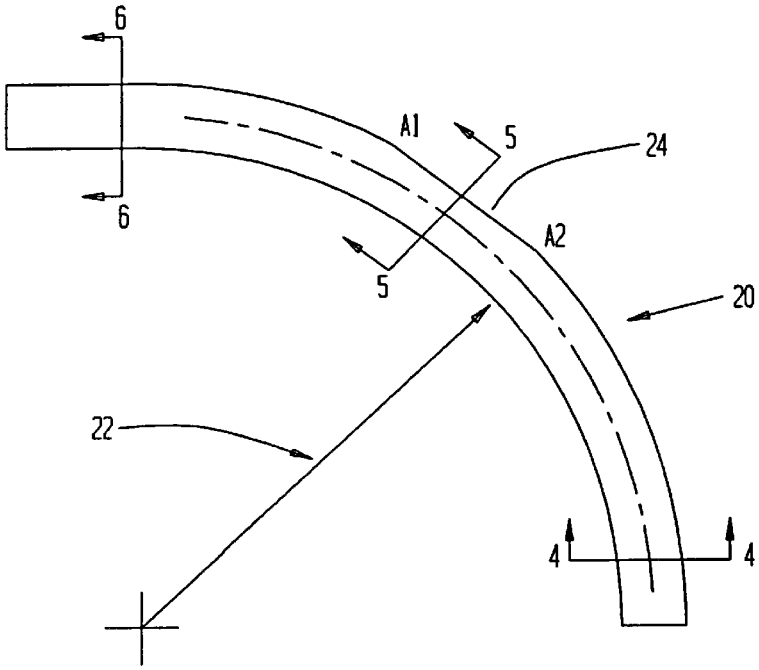
FIG. 3 is an illustration of a section of small diameter metal tubing bent by a standard method of bending tubing to achieve a minimum wall collapse wherein the bend radius is three inches.

Referring to FIGS. 1 and 2, a section of thin walled metal tubing 10 having a wall thickness 12 an outside diameter 14 and an inside diameter 16 is shown. The section of metal tubing 10 in the preferred embodiment is made of steel, however it should become apparent to those skilled in the art that any rigid metal may be substituted. The tubing 10 is standard metal tubing having an outside diameter of approximately one inch or less. Referring now to FIG. 3, a section of ⅜ inch outer diameter tubing 20 is shown having an inside radius 22 selected in order to minimize a wall collapse 24 located between points $A_1$ and $A_2$ on an outside radius. For ⅜ inch outer diameter steel tubing, the inside radius 22 is three inches to achieve a minimum wall collapse 24 in the range of 11–15%. The inside radius 22 of the bent tubing 20 may be selected based on a desired minimum wall collapse 24. The wall collapse 24 is a function of the material properties of the tubing 20 including the yield strength and ductility of the metal. When the section of bent tubing 20 is manufactured by a standard process it is necessary to select a sufficiently large inside radius 22 in order to minimize the wall collapse 24. If a bend radius smaller than inside radius 22 is desired the amount of wall collapse 24 is increased.

Figures 4, 5, 6:
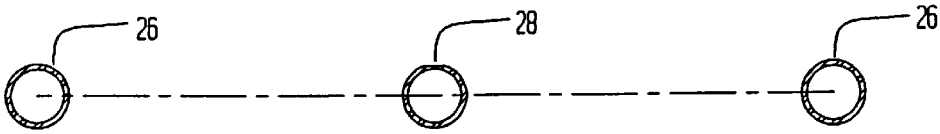
FIG. 4 is a cross-sectional view taken along the line 4—4 of FIG. 3.
FIG. 5 is a cross-sectional view taken along the line 5—5 of FIG. 3.
FIG. 6 is a cross-sectional view taken along the line 6—6 of FIG. 3.

Referring now to FIGS. 3–6, FIGS. 4 and 6 illustrate a generally uniform cross-section 26 through which fluid may flow. FIG. 5 illustrates a collapsed cross-section 28 of the wall collapse 24. Specifically, FIG. 3 is an illustration of ⅜ inch O.D. metal tubing bent to achieve a minimum wall collapse resulting in a reduction of 11–15% in flow area. The reduction of flow area is the percent difference between uniform cross-section 26 and collapsed cross-section 28. Using a standard method of bending, typically achieved with devices driven by air cylinders, ⅜ inch metal tubing must have a minimum inside radius 22 of three inches, which is a standard bend radius to achieve a minimum wall collapse 24, resulting in a desired reduction in flow area in the range of 11–15%. It is desired to maintain the reduction in flow area of 11–15% while significantly reducing the bend radius.

The present invention is a method for bending metal tubing wherein a reduced bend radius may be achieved by minimizing the material stress during bending. By determining a rate of bending to reduce a material stress a reduced bend radius may be achieved while minimizing wall collapse. Material properties such as yield strength and ductility determine the amounts of wall collapse and wall thinning metal tubing may experience during bending.

Page 92 of *The Principles of Physical Metallurgy* by Gilbert E. Doan and Elbert M. Mahla (McGraw-Hill Book Company, Inc. 1941), incorporated herein by reference, discloses the effects of the rate of deformation on sheer stress for metal. As the rate of deformation increases the sheer stress applied to the material also increases. When the rate of deformation is increased more force is required to achieve the same amount of deformation in the material. This is because the higher rate of deformation results in strain hardening of the material. As material is strain hardened the ductility of the material is reduced resulting in a reduction in the material's ability to plastically deform without fracture.

Therefore, by reducing the rate of bending at which metal tubing is bent, the resulting strain hardening may be eliminated and the material's ductility may be maintained. This result enables metal tubing to be bent, with a significantly smaller bend radius, while maintaining ductility and hardness. By maintaining the material's ductility and hardness during bending the elongation of the material on the outside radius of the metal tubing at the bend is reduced. Elongation is created during bending when material is strain hardened, the material, not being as ductile, "pulls" into a cord or straight line as opposed to following the bend as more ductile material would behave. Strain hardened material resists bending and therefore is forced to elongate. Steel is stronger in compression than in tension, this also forces the material on the outside bend radius to stretch instead of the material located at the inside radius 22 to compress. As this material elongates or stretches it naturally follows that the material must thin. Therefore by applying the method of the present invention thinning of the tube wall is also reduced.

Figure 7:
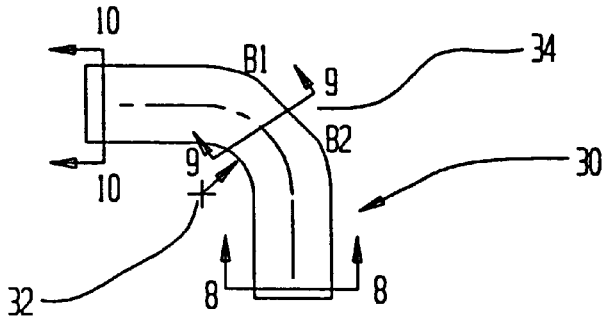
FIG. 7 is an illustration of a section of small diameter metal tubing bent according to the method of bending tubing according to the preferred embodiment of the present invention to achieve a minimum wall collapse wherein the bend radius is one-quarter inch.
Figures 8, 9, 10:
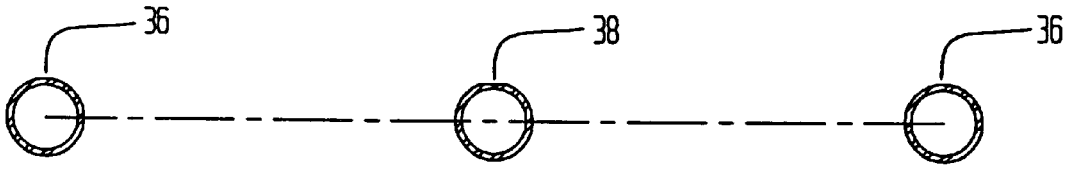
FIG. 8 is a cross-sectional view taken along the line 8—8 of FIG. 7.
FIG. 9 is a cross-sectional view taken along the line 9—9 of FIG. 7.
FIG. 10 is a cross-sectional view taken along the line 10—10 of FIG. 7.

Referring now to FIG. 7 a section of bent tubing 30 having an outside diameter 14 of ⅜ inch bent by the improved bending method disclosed herein has an inside radius 32 of ¼ inch. For steel tubing having a ⅜ inch outside diameter, the bending rate is approximately ⅓ of the rate of bending for a device driven by air cylinders for bending ⅜ inch diameter tubing. The wall collapse 34 located between points B1 and B2 on tubing 30 has a reduction in flow area in the range of 11–15% as does tubing 20 of FIG. 3. However, the section of tubing 30 has a significantly reduced inside radius 32 of ¼ inch compared to inside radius 22 of three inches to achieve the same reduction in flow area. Referring now also to FIGS. 8–10 the generally uniform cross-section 36 when compared to a collapsed cross-section 38 taken perpendicular to wall collapse 34 is similar to that of FIG. 3.

The novelty of the present invention is further realized when considering relationships between minimum bend radius, diameter and the percent of material elongation, as disclosed in the *Tool Engineers Handbook* by A.S.T.E. Handbook Committee, American Society of Tool Engineers, Detroit, Mich. (McGraw-Hill Book Company, Inc. 1949) on page 975 in Table 66-1, incorporated herein by reference. According to Table 66-1 for a metal tube with a diameter of two inches or less when bent to a minimum bend radius of one when the elongation experienced by the material is 70%, indicating significant material thinning and hardening. Therefore it must be presumed that a significant reduction in flow area must also result according to the information provided in Table 66-1.

It will be understood by those skilled in the art that the method of bending tubing disclosed herein will minimize the reduction in flow area as a result of bending and minimizing the amount of thinning that also occurs during bending. In addition, it will be appreciated that the present invention is susceptible to modification, variation and change. It is therefore to be understood that within the scope of the appended claims, the invention may be practiced otherwise than specifically described.

What is claimed is:

1. A method of bending metal tubing comprising the steps of:

selecting a bend radius less than a standard minimum inside bend radius;

determining a maximum rate of bending of a length of tubing at the standard minimum inside bend radius which will achieve a reduction of flow area of less than 15%;

bending the tubing at a radius of less than said standard minimum inside bend radius at a rate of less than half the determined rate to achieve a reduction in flow area of less than 15%.

2. A method of bending metal tubing of claim 1 wherein the wall collapse is in a range of 11% to 15%.

3. A method of bending metal tubing of claim 1 wherein the diameter of the tubing is ⅜ inch.

4. The method of bending metal tubing of claim 3 wherein the selected radius is ¼ of an inch.

5. A method of bending metal tubing, comprising the steps of:

selecting a bend radius, wherein the desired bend radius is 50% of a standard minimum inside bend radius to achieve a minimum wall collapse for metal tubing having an outside diameter of D and a wall thickness T;

determining a rate of bending of the tubing less than a standard rate of bending for tubing having an outside diameter D and an end wall thickness T such that reduction in flow air is between 11 and 15%; bending a tubing at the rate of bending whereby the selected bend radius is achieved while the reduction in flow area is between 11 and 15%.

6. The method of bending metal tubing of claim 5 wherein the selected bend radius is 40% of the standard minimum inside bend radius to achieve a a reduction in flow area of less than 15%.

7. The method of bending metal tubing of claim 5 wherein the selected bend radius is 30% of the standard minimum inside bend radius to achieve a reduction in flow area of less than 15%.

8. The method of bending metal tubing of claim 5 wherein the selected bend radius is 20% of the standard minimum inside bend radius to achieve a reduction in flow area of less than 15%.

9. The method of bending metal tubing of claim 5 wherein the selected bend radius is 10% of the standard minimum inside bend radius to achieve a reduction in flow area of less than 15%.

10. The method of bending metal tubing of claim 5 wherein D, the outside diameter of the tubing, is less than one inch.

11. The method of bending metal tubing of claim 5 wherein D, the outside diameter of the tubing, is ⅜ of an inch.

12. A method of bending metal tubing, comprising the steps of:

selecting a bend radius less than the standard minimum inside bend radius; determining a maximum rate of bending of the standard minimum inside bend radius such that there is a reduction of flow area of less than 15% after bending; bending the tubing at less than ½ the determined rate whereby said selected bend radius is achieved accompanied by a reduction in flow area of less than 15 %.

* * * * *